US006266946B1

(12) United States Patent
Aylward

(10) Patent No.: US 6,266,946 B1
(45) Date of Patent: Jul. 31, 2001

(54) POSITIVE COUNT ROTARY SLAT PACKAGING APPARATUS AND RELATED METHODS

(75) Inventor: John T. Aylward, New Bern, NC (US)

(73) Assignee: Aylward Enterprises, Inc., New Bern, NC (US)

( * ) Notice: Subject to any disclaimer, the term of this patent is extended or adjusted under 35 U.S.C. 154(b) by 0 days.

(21) Appl. No.: 09/640,927

(22) Filed: Aug. 17, 2000

Related U.S. Application Data

(63) Continuation of application No. 09/082,137, filed on May 20, 1998.

(51) Int. Cl.[7] ..... B65B 1/10; B65B 5/10

(52) U.S. Cl. ..... 53/501; 53/244

(58) Field of Search ..... 53/202, 244, 250, 53/251, 502

(56) References Cited

U.S. PATENT DOCUMENTS

| | | | | |
|---|---|---|---|---|
| 1,383,623 | | 7/1921 | Groves . | |
| 1,824,432 | | 9/1931 | Hendry . | |
| 1,839,327 | | 1/1932 | Mayo . | |
| 2,479,667 | | 8/1949 | Boylan . | |
| 2,585,558 | | 2/1952 | Lakso . | |
| 2,845,759 | | 8/1958 | Cote et al. . | |
| 3,028,713 | | 4/1962 | Kennedy et al. . | |
| 3,139,713 | * | 7/1964 | Merrill et al. | 53/55 |
| 3,225,513 | | 12/1965 | Ehe . | |
| 3,354,607 | * | 11/1967 | Lakso | 53/254 |
| 3,387,695 | | 6/1968 | Hendrickson . | |
| 3,417,542 | * | 12/1968 | Merrill et al. | 53/167 |
| 3,925,960 | * | 12/1975 | Saari et al. | 53/167 |
| 3,979,878 | | 9/1976 | Berney . | |
| 4,017,003 | * | 4/1977 | Heino | 221/81 |
| 4,265,072 | * | 5/1981 | Egli | 198/46 |
| 4,674,259 | * | 6/1987 | Hills | 53/202 |
| 4,677,283 | | 6/1987 | Lewis . | |
| 5,515,668 | | 5/1996 | Hunt et al. . | |
| 6,185,901 | * | 2/2001 | Aylward | 53/250 |

FOREIGN PATENT DOCUMENTS

| | | |
|---|---|---|
| 20558/34 | 12/1934 | (AU) . |
| 2203856 | 10/1998 | (CA) . |

* cited by examiner

*Primary Examiner*—Ira S. Lazarus
*Assistant Examiner*—Nathaniel Chukwurah
(74) *Attorney, Agent, or Firm*—Alston & Bird LLP

(57) ABSTRACT

An automated positive count rotary slat packaging apparatus and related methods include independently rotatable rotary slats. In one embodiment, the apparatus also includes a positive count mechanism disposed in the pill delivery path adjacent the containers and a controller which is capable of generating an alarm or determining when a bottle is filled incorrectly. Accordingly, underfilled containers can be independently filled by further rotating only the respective rotary slat. A drive device for each rotary slat is also provided having frustoconical drive wheels connected to the ends of counterrotating drive shafts. The drive wheels, which are driven by a motor, engage corresponding frustoconical drive surfaces of the rotary slats to thereby rotate the slats.

5 Claims, 8 Drawing Sheets

POSITIVE COUNT ROTARY SLAT PACKAGING APPARATUS AND RELATED METHODS

CROSS-REFERENCE TO RELATED APPLICATIONS

This application is a continuation of U.S. application Ser. No. 09/082,137, filed May 20, 1998, which is incorporated by reference in its entirety.

FIELD OF THE INVENTION

The present invention relates to packaging machines, and more particularly relates to automated packaging machines for filling container bottles with pills.

BACKGROUND OF THE INVENTION

Pharmaceutical medicines and associated packaging apparatus are typically subject to relatively strict consumer protection guidelines. For example, pills, capsules, and the like, must be produced and packaged in such a way as to at least meet the minimum sterility requirements mandated by federal regulations. In addition, the pills should be delivered into the packaging such that the contents accurately meet the claimed labelling "count", i.e., each package includes exactly the predetermined number of pills. Notwithstanding the above, it is also desired to package the product in a mass production operation to offset costs typically attributed to a labor intensive operation in order to provide an economic product.

In the past, pill filling machines have been proposed which provide automated bottle counts by filling a hopper with pills and causing a plurality of the pills to be caught by a pill capturing device, such as an array of rotary slats. The rotary slats drop the captured pills into a plurality of bottles disposed in alignment with the dropping pills. The bottles are distributed along an endless conveyor belt which is timed to advance and stop the bottles according to the filling operation.

Conventional pill capturing devices more particularly include a series of rotary slats each configured to receive, hold and move a plurality of capsules or pills along a closed path. The rotary slats are typically discs fixed on a rotatable shaft and having a plurality of openings in the peripheral surface thereof for capturing individual pills. Accordingly, the closed path is arcuate and generally disposed between a pill hopper and discharge area above the conveyor belt. By the rotary action of the slat, the pills move in a direction normal to the bottle advancing automated conveyor belt. The pill capturing device then generally discharges the pills by rotating the slats which move corresponding to the closed path such that they fall out of the respective openings at the filling station. The pills are often funneled through a chute which empties into a corresponding bottle.

The count, or number of pills in the bottle, is determined by positioning the bottles in the pill dropping zone for a predetermined time. The duration of the filling operation for each bottle corresponds to the number of openings in each slat which the machine is capable of delivering to the bottles per unit of time. The duration of the filling operation, speed of the rotary slats and configuration of the pill capturing device are used to calculate the count.

U.S. Pat. No. 3,139,713 to Merrill proposes a machine with a discharge chute which is divided into a number of discharge compartments corresponding to the number of bottles being filled at the filling operation. As described, each bottle is to be filled with a count of one hundred pills. Each discharge chute receives five pills from one row or flight of the pill capturing device when the capturing device reaches a discharge position. In order to complete the filling operation, each bottle in the row receives twenty of the 5-article carrying flights.

Similarly, U.S. Pat. No. 4,674,259 to Hills proposes a series of elongated slats with cavities for carrying tablets to a set of chutes. The chutes operate with reciprocating movement to deliver the pills between first and second rows of bottles positioned at the filling station.

Unfortunately, if the pill capturing device fails to capture a pill in each and every cavity or receptacle, or if a pill should mistakenly be diverted, at least one of the bottles can be improperly filled. The conventional solution to this problem is to situate an operator adjacent to the slats to ensure that each receptacle is filled with a pill. If a pill is missing, the operator manually places a pill in the receptacle. Such an approach involves labor costs and can be unsatisfactory for sterility purposes.

In addition, the accuracy of the count of each bottle is largely determined by the operator and, as such, a fully and consistently accurate count cannot be guaranteed. Accordingly, there is a great need for a device which provides an accurate count for each bottle but which takes advantage of the high speed and efficiency of a rotary slat apparatus.

SUMMARY OF THE INVENTION

These and other objects and advantages are met by the packaging apparatus of the present invention having a plurality of rotary slats, each of which is independently driven. A separate counting device is associated with each rotary slat for counting each pill as it falls from the slat into the container. As such, a positive count is provided for each container and improperly filled slats will not affect the total count for that container. If a particular container has a low count, the respective slat can be further rotated to fill the container. Because the slats are independently driven, the other slats can remain stationary to prevent overfilling.

In particular, the packaging apparatus comprises a reservoir configured to hold a plurality of randomly oriented pills and define at least one opening adjacent a lower portion thereof. The plurality of rotary slats each have a peripheral edge portion rotatable into the opening in the reservoir. The peripheral edge portions of the rotary slats each define a plurality of pill receptacles configured to capture an individual pill at a first position in the reservoir and release the pill at a second position outside of the reservoir.

A conveyor is configured to move a plurality of open containers along a predetermined path of travel and position a container adjacent a respective rotary slat to define a delivery path extending between the second position of the rotary slat and the container. The pills are released from the slat and fall along the delivery path into the corresponding container. The apparatus also includes a plurality of drive motors in driving engagement with each of the rotary slats for rotating the respective slat and a controller connected to each of the drive motors for independently controlling the drive motors such that the slats can be rotated for different durations.

Another aspect of the invention is a novel drive device for driving each of the rotary slats. The drive device includes a rotatable drive motor, a pair of drive shafts connected to the drive motor and a pair of drive wheels connected to a respective drive shaft. The drive wheels each have frustoconical drive surfaces which are engaged with corresponding frustoconical drive surfaces on opposite sides of the rotary slat. Accordingly, rotation of the drive motor causes rotation of the rotary slat. A pneumatic cylinder is provided behind the drive motor for advancing and pressing the spaced apart frustoconical drive wheels against the rotary slat. This allows quick disengagement of the drive device when a changeover of rotary slats is desired (such as when a differently sized pill is to be packaged). Also, the constant pressure allows for continual engagement of the drive wheels during operation, even if the wheels begin to wear.

The apparatus also advantageously includes the counting devices discussed above disposed along each of the delivery paths for counting pills delivered along the path such that the number of pills passing into each container can be positively determined. In a preferred embodiment, each counting device is disposed adjacent to the respective open container and includes a light source which generates a continuous beam of light across the delivery path and an opposing light receiver which senses when the light is interrupted by each pill passing into the container. In addition, the controller is also preferably connected to the counting devices, and an alarm is connected to the counting devices for creating an alarm signal when any one of the containers is not full.

Associated methods also form a part of the invention. A preferred method first includes capturing a plurality of pills in individual pill receptacles formed on a plurality of rotary slats. The-rotary slats are rotated to a position where the pills are released from the receptacles thereby allowing the pills to fall from the receptacles into the containers and define a delivery path. As each pill falls along the delivery path of a rotary slat, it is counted to positively determine to the number of pills deposited into the respective container. In a preferred embodiment, the method also includes the step of rotating each of the rotary slats independently with a separate drive motor.

The foregoing and other objects and aspects of the present invention are explained in detail in the specification set forth below.

DETAILED DESCRIPTION OF THE PREFERRED EMBODIMENTS

The present invention will now be described more fully hereinafter with reference to the accompanying figures, in which preferred embodiments of the invention are shown. This invention may, however, be embodied in many different forms and should not be construed as limited to the embodiments set forth herein. Like numbers refer to like elements throughout.

Generally described, the present invention is directed to an automated rotary slat packaging apparatus 10 which delivers pills 11 from a reservoir 12 into a container 35. The term "pill" is used herein throughout but the term is not intended to be limiting and includes any discrete articles of the type used in the pharmaceutical industry or otherwise including, but not limited to, capsules, caplets, gelcaps and tablets. Similarly, the receiving container 35, although illustrated as a bottle throughout, is not limited thereto and can be any one of a number of configurations which provides an opening for receiving discrete articles therein, such as pouches or boxes.

Figure 1:
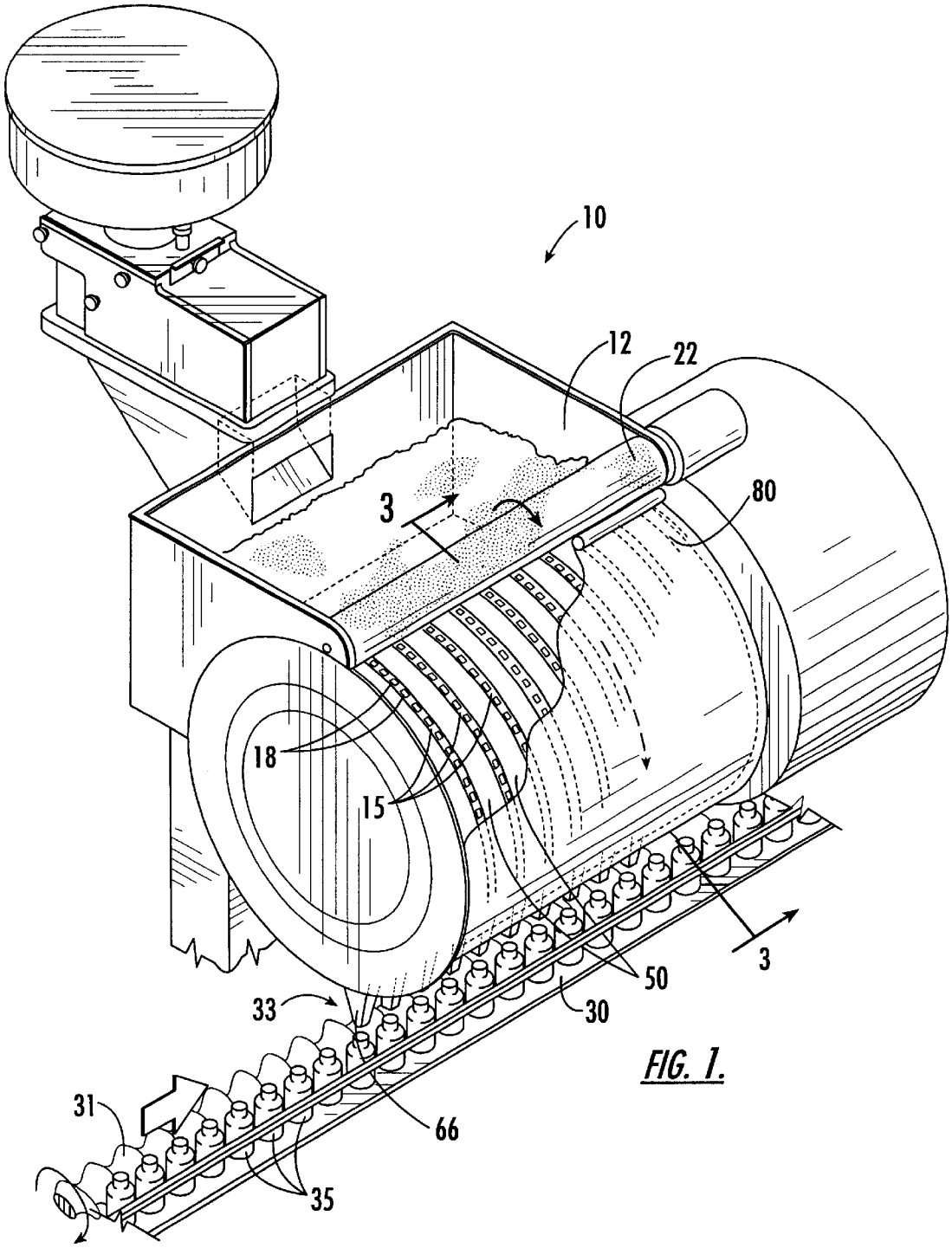
FIG. 1 is a perspective view of an automated packaging apparatus according to the present invention.
Figure 3:
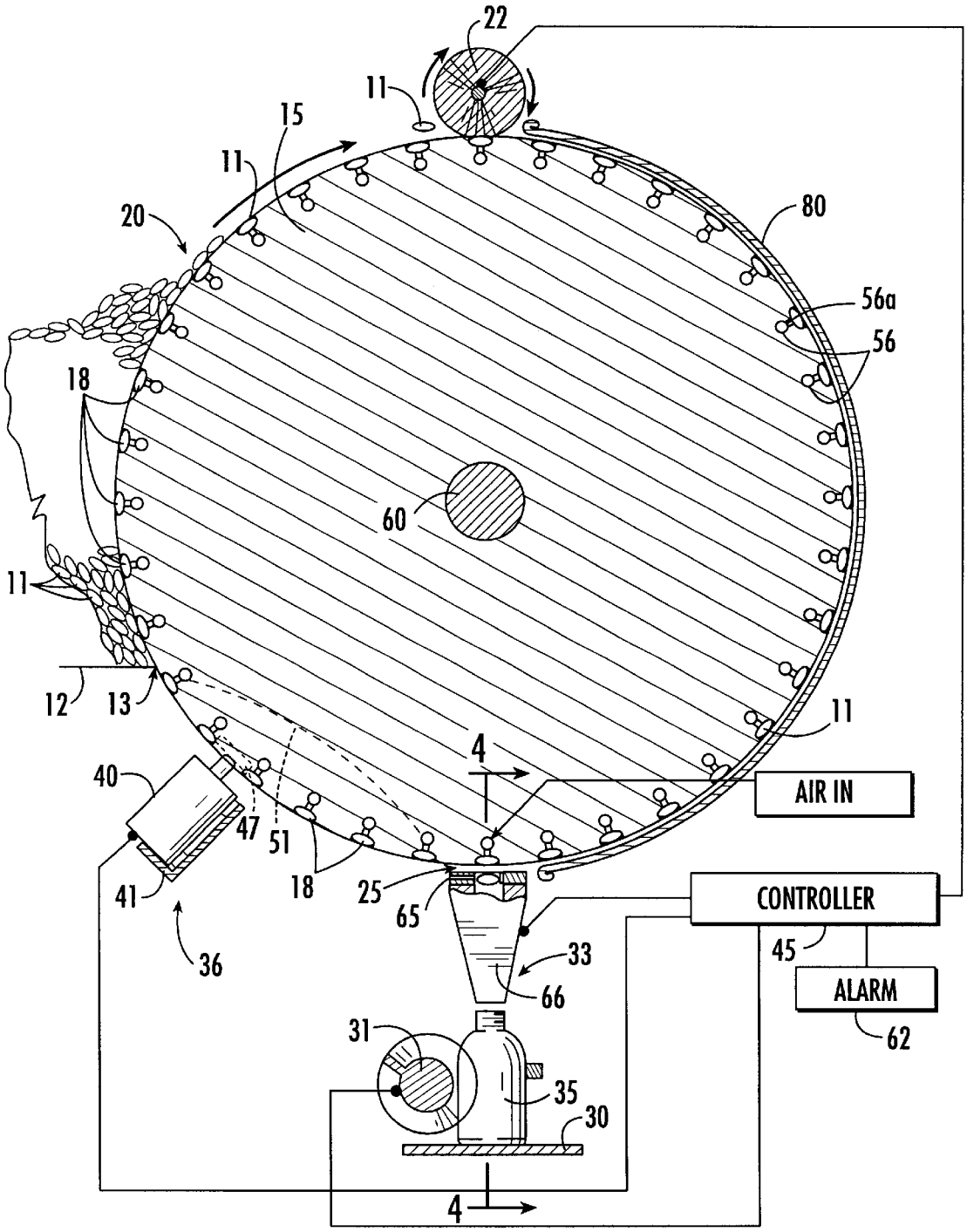
FIG. 3 is a sectional view of the apparatus taken along line 3—3 of FIG. 1.

As shown in FIGS. 1 and 3, the automated packaging apparatus 10 includes the reservoir 12, a plurality of rotary slats 15, a plurality of stationary spacers 50, a plurality of counting devices 65, and a conveyor system 30. As shown in FIGS. 3, 7, 7A and 7B, the apparatus also includes a plurality of drive devices 36 and a controller 45. A filling station 33 is defined by a respective rotary slat 15, counting device 65, and an aligned container or bottle 35. As such, the apparatus includes a plurality of filling stations 33 corresponding to the number of rotary slats 15.

Figure 2:
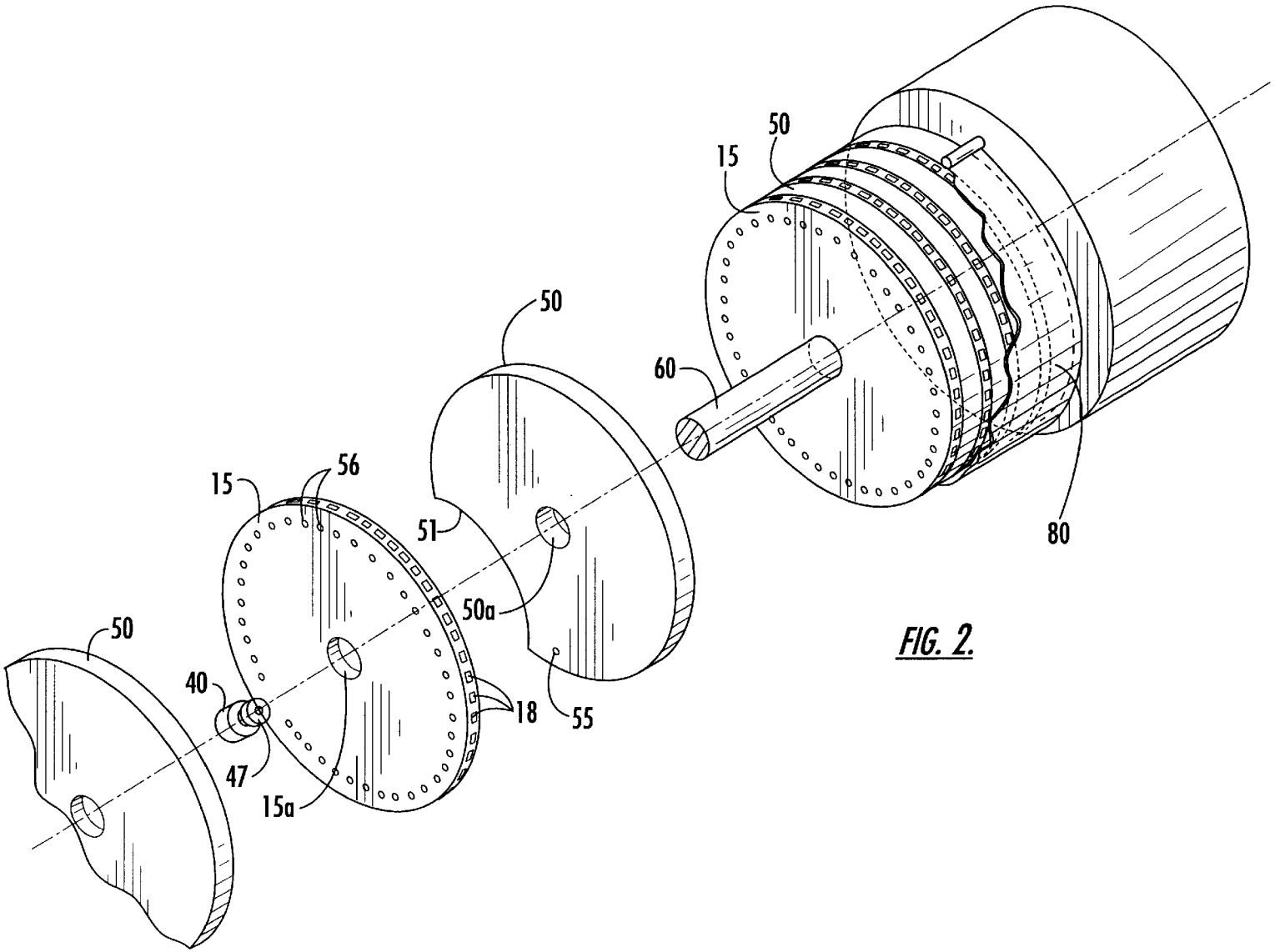
FIG. 2 is a partial exploded assembly drawing of a plurality of rotary slats and stationary spacers on a support shaft.
Figure 9:
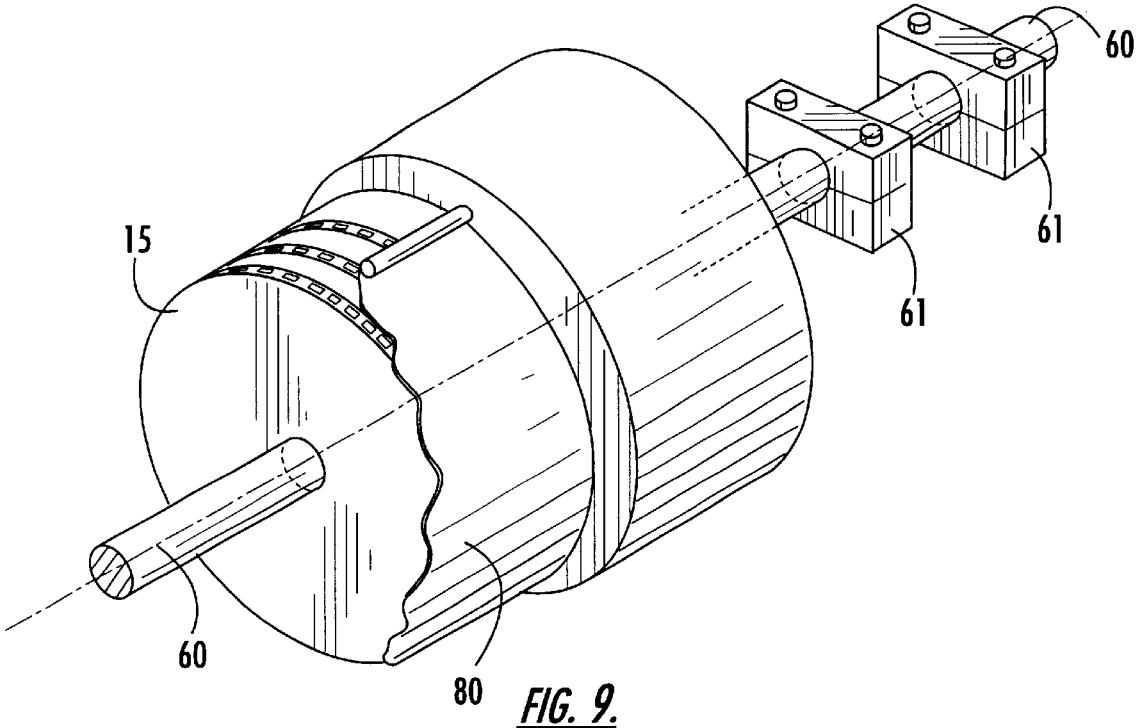
FIG. 9 is a cutaway perspective view illustrating the common shaft and a pair of clamping blocks from which the shaft is cantilevered.

As shown in FIG. 2, each of the rotary slats 15 and the stationary spacers 50 are individually removable from and assembleable on a support shaft 60. The support shaft 60 is preferably cantilevered from one end by a pair of clamping blocks 61, illustrated schematically in FIG. 9, so that the other end remains generally unsupported (a cover may be removably secured to the free end). The slats 15 and spacers 50 can easily be removed over the free end of the support shaft 60.

The assembly and disassembly flexibility provided by the invention is such that the apparatus 10 can accommodate different numbers of filling stations (such as the ten illustrated) by increasing or decreasing the number of rotary slats on the shaft 60. Further, if one of the components malfunctions, the other filling stations 33 remain operable and, advantageously, modular repair or replacement of only the problematic slat or spacer can improve repair costs and decrease machine downtime.

Each of the rotary slats 15 and stationary spacers 50 illustrated in FIG. 2 includes aligned apertures 15*a*, 50*a* for individually receiving the support shaft 60 therethrough. Preferably, each of the rotary slats 15 is configured the same to allow full interchangeability of position in the apparatus and along the support shaft 60. Similarly, it is preferred that each of the stationary spacers 50 is configured the same for interchangeability.

Figure 6:
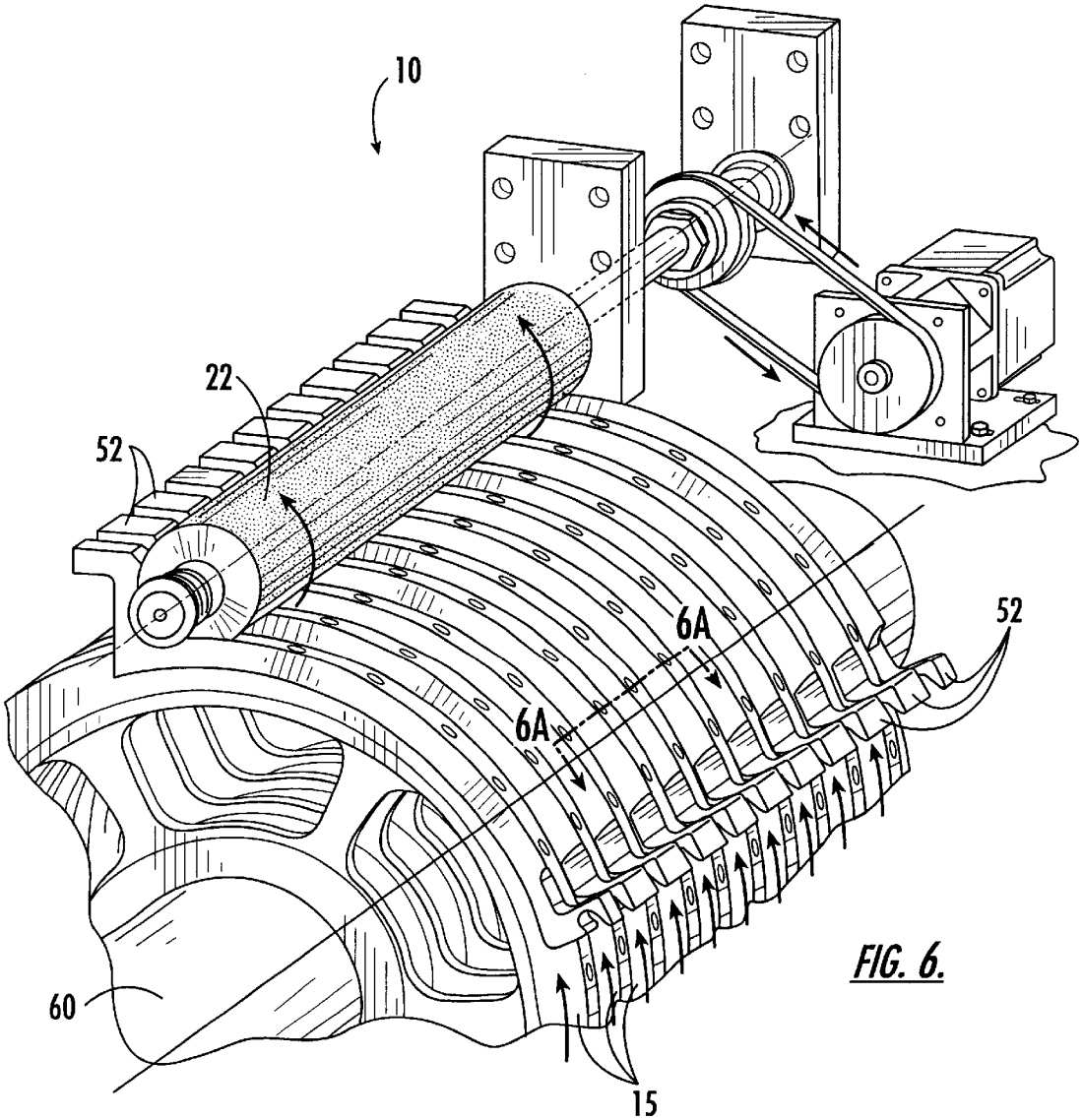
FIG. 6 is a partial perspective view of the apparatus shown with a restraining blanket removed to illustrate the structure of a plurality of spaces.
Figure 6A:
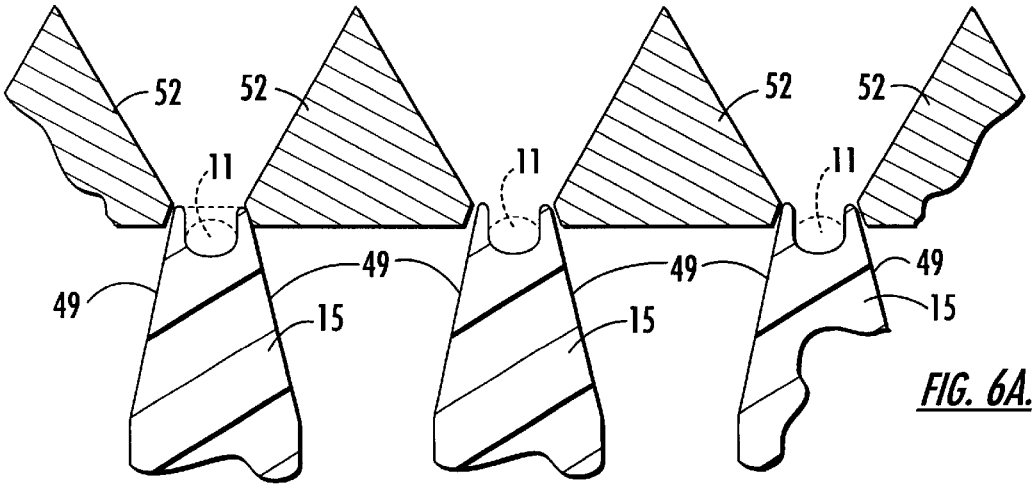
FIG. 6A is a sectional view taken along line 6A—6A of FIG. 6 and illustrating the shape of the spacers according to one embodiment.

An alternative embodiment of the spacer 52 is illustrated in FIGS. 6 and 6A. Each of these spacers 52 has a generally quarter-circle shape which fits in place between the rotary slats 15 for the portion of the path of travel of the rotary slats which extends through the reservoir 12. Accordingly, it is not necessary for the shaft 60 to extend through the spacers 52 and the spacers can be easily removed (after removal of the reservoir 12) in a radial direction. The spacers 52 define a peaked cross-section, best seen in FIG. 6A, so that pills 11 in the reservoir 12 will be more easily channeled into the rotary slats 15.

Each rotary slat 15 is operably connected with a separate drive device 36 so that it can be operated individually, or separate from, the other rotary slats 15. Although only one drive device 36 is illustrated in FIGS. 2 and 3, the remainder of the motors are positioned serially along the backside of the rotary slats 15 aligned with the illustrated motor. The drive devices 36 can all be supported on a common rack or support member 41. In this configuration, if it is desired to package a different type of pill and the slats 15 and/or spacers 50 are changed out for others, the drive devices 36 can also be easily changed, if necessary, by removing the support member 41 (with the drive devices attached) and substituting another support member having the new drive devices thereon.

Figure 7:
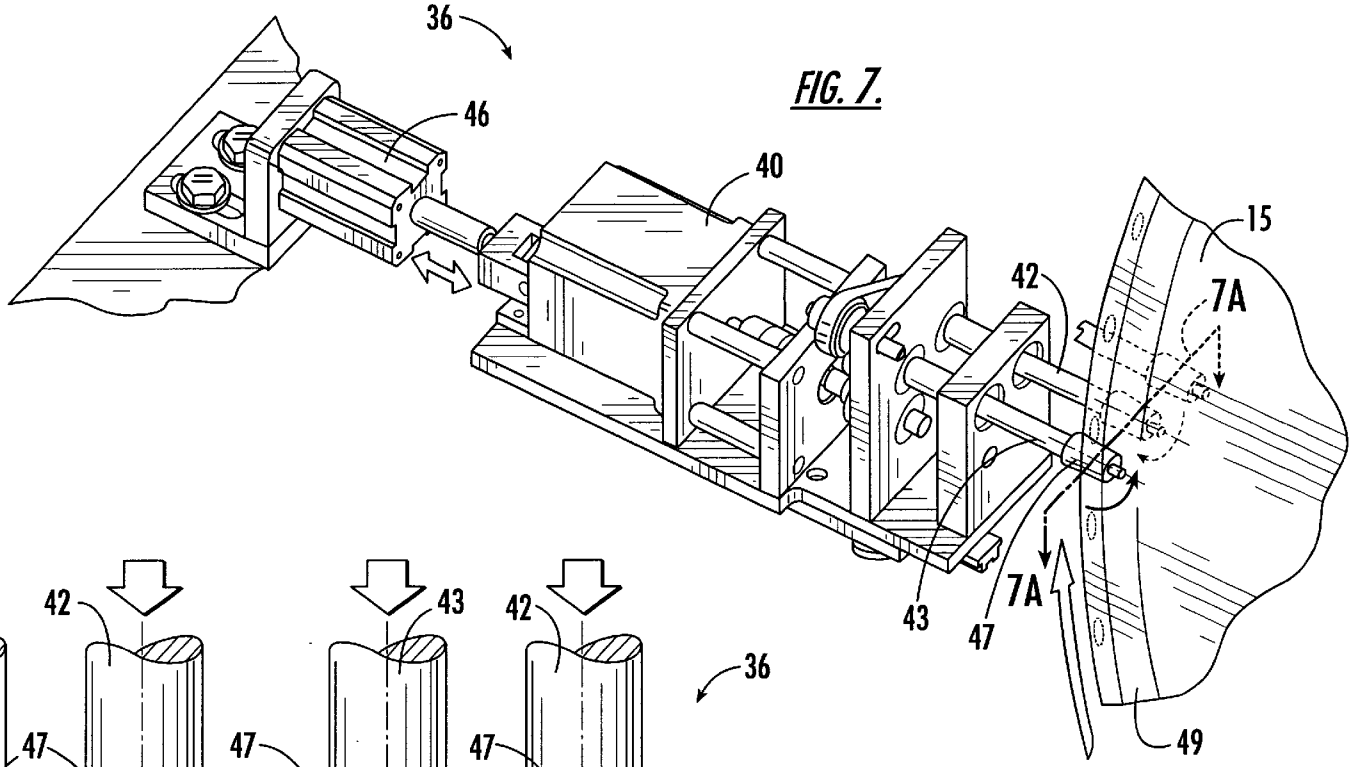
FIG. 7 is a perspective view of a drive device for one of the rotary slats.
Figure 7A:
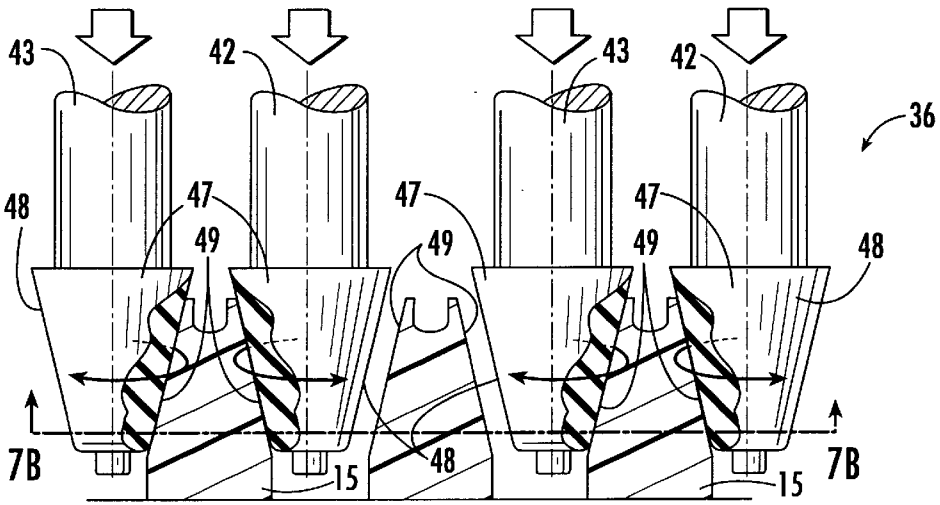
FIG. 7A is a sectional view taken along line 7A—7A of FIG. 7 and illustrating the frustoconical shape of the drive wheels.
Figure 7B:
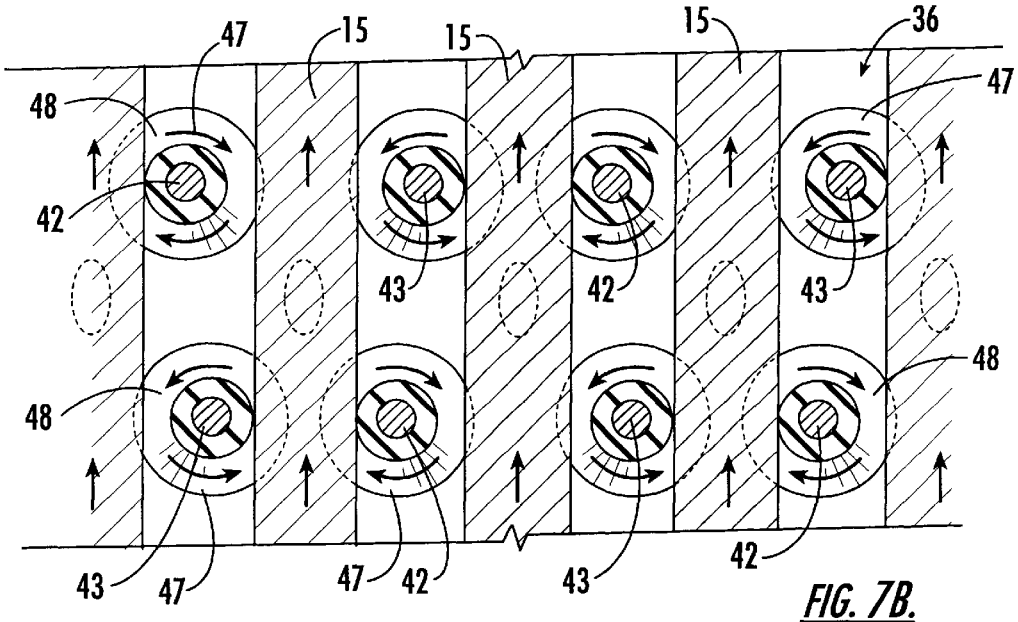
FIG. 7B is a sectional view taken along line 7B—7B of FIG. 7A.

A particularly advantageous drive device 36 is illustrated in FIGS. 7, 7A and 7B. The drive device 36 includes a drive motor 40 which is rotatable in a given direction. One or more belts and pulleys (or other conventional power transmission equipment) are used to couple the drive motor 40 to first and second drive shafts 42,43. The drive shafts 42,43 are coupled to the drive motor 40 to rotate in opposite directions and at the same speed.

Each of the drive shafts 42,43 is fitted with a drive wheel 47. The drive wheels 47 have a tapered, frustoconical shape so as to define a drive surface 48. The drive wheels 47 are formed of an elastomeric traction material such as hard rubber. The rotary slats 15 are also provided with a pair of frustoconical drive surfaces 49 for engagement by the drive surfaces 48 of the drive wheels 47. Accordingly, rotation of the drive motor 40 causes the drive shafts 42,43 to rotate which in turn causes the respective rotary slat 15 to rotate. It would be appreciated by one of ordinary skill in the art that the conical angles of the guide surfaces 48 and 49 are determined based on the respective diameters of the drive wheel 47 and the rotary slat 15 such that there is no scuffing or sliding of the drive wheel on the surface of the slat. It would be further appreciated that the conical angles as illustrated are exaggerated (given the illustrated sizes of the drive wheels 47 and rotary slat 15) to facilitate a better understanding of the invention.

An actuator 46, such as a pneumatic cylinder, is provided in the frame of the apparatus 10. The actuator 46 is capable of retracting the drive device 36 relative to the rotary slat 15 so that a changeover of rotary slats can be easily effected by withdrawing the wheels 47 from the slat. In addition, however, the actuator can advance the drive wheels 47 and press the wheels against the rotary slat with a substantially uniform force. Accordingly, if there is any wear between the respective drive surfaces 48,49, the actuator will maintain a constant pressure (such as by incrementally advancing the wheels 47) to compensate for the wear and prevent slippage. The functions of disengaging the drive device 36 from the rotary slat 15 and of maintaining pressure on the drive wheels 47 could be performed by separate and different devices, however, such as a mechanical linkage for the former and a compression spring for the latter.

Another advantage of the drive device 36 according to this embodiment of the invention is that the lateral force applied to a rotary slat 15 by one of the drive wheels 47 is balanced by the lateral force of the other wheel of the device. In other words, the net resultant bending moment applied to the rotary slat 15 is zero. As such, the bearings used for supporting the rotary slats 15 on the support shaft 60 need not be of a type which are designed for resisting bending moments. With the present invention, it is even possible to use a plain bearing configuration where the inner surfaces of the apertures 15a ride directly on the support shaft 60 with no intervening rolling elements.

A preferred arrangement for the drive devices 36 is illustrated in FIG. 7B. The relatively narrow spacing between the rotary slats 15 (which is determined at least in part by the size of the containers 35) may not provide sufficient room for the adjacent drive wheels 47 of two adjacent drive devices 36 to be positioned side-by-side. In such cases, the drive devices 36 can be positioned alternately in separate rows across the apparatus. The drive shafts 42,43 (and the drive wheels 47) of one alternating plurality of drive devices 36 are positioned in a plane separate from the drive shafts of the other alternating plurality of drive devices to allow room for both sets of drive wheels 47.

The spacer 50 of FIGS. 2 and 3 defines a cut-out portion 51 to provide access for the drive wheels 47 against the adjacent rotary slats 15. A single drive wheel 47 could alternatively contact the generally cylindrical outer surface of the respective rotary slat 15. If the latter is the case, the cylindrical outer surface of the rotary slat 15 can define a cross section having recessed contour such that the drive wheel 47 engages only the higher portions on either side of the recessed portion.

It is preferred that the drive motor 40 be a variable speed unit, such as a stepper motor, the speed being controlled by the central controller 45. The unit can have at least a first and second drive speed. The first drive speed will operate during the initial portion of the pill filling operation. Upon delivery of a predetermined number of pills 11 to the container 35, the drive motor 40 will slow to finish the filling operation and prevent underfill or overfill of the container. For example, if a rotary slat 15 was to be stopped abruptly from a high rotational speed at the intended end of the count cycle, it is theoretically possible that an additional pill could be dislodged prematurely from the rotary slat or that the intended last pill of the count is ejected in a trajectory which causes it to miss the container. The slower speed prevents such possibilities. Further, as will be discussed in more detail hereinbelow, if the controller 45 (or operator) should determine that an improper count exists at a particular filling station 33, that respective rotary slat 15 can be individually advanced (preferably automatically, i.e., without operator input) at a predetermined speed to provide a correct pill count in the container 35.

As shown in FIG. 3, each rotary slat 15 rotates in a clockwise direction defining an arcuate delivery path from a first, pill capture position at an opening in the reservoir shown generally at position 20 to a second, release position, generally about 180–270 degrees away from the first position 20, shown as position 25, where the pill is released. The rotary slat includes a plurality of serially aligned pill receptacles 18. Preferably, the receptacles 18 are sized and configured to receive one pill 11 therein such that, when properly seated, the top of the pill is substantially flush with the outer peripheral edge of the rotary slat 15. However, it would be appreciated that at least a portion of the pill 11 could extend beyond the edges of the receptacle 18. The stationary spacer 50 can also be configured with raised or crowned peripheral edges, similar to the spacer 52 illustrated in FIG. 6A, to further direct pills 11 into the rotary slats 15.

Figure 4:
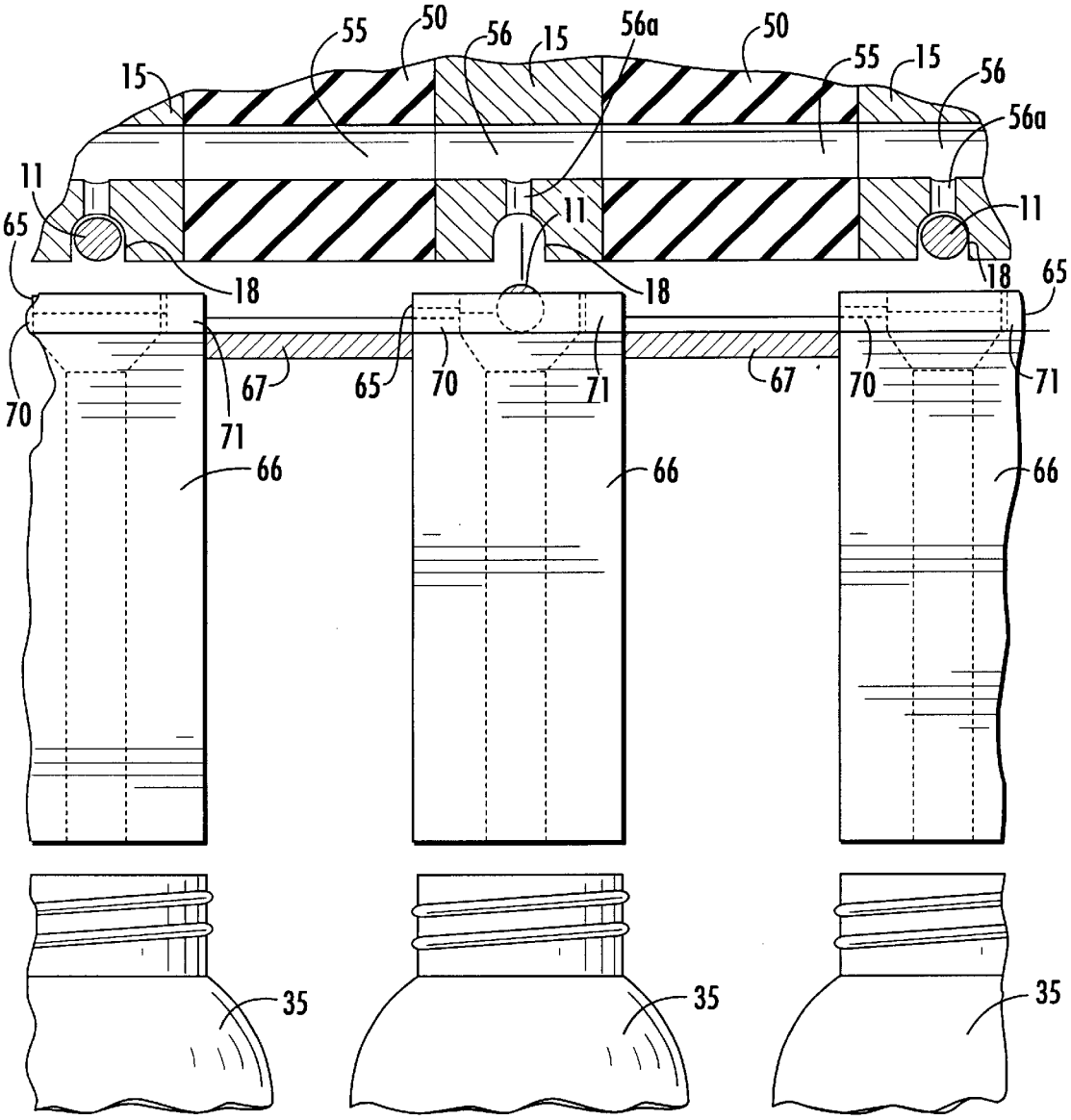
FIG. 4 is a sectional view taken along line 4—4 of FIG. 3 and illustrating a positive count pill delivery path between a rotary slat and a container.
Figure 5:
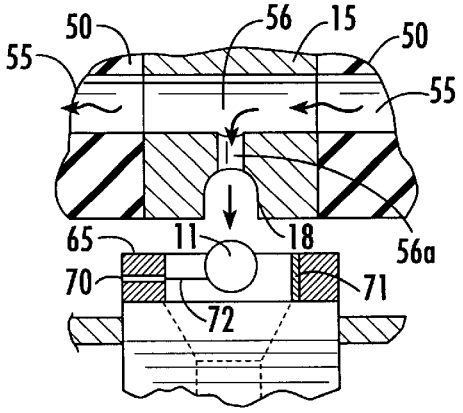
FIG. 5 is a partial view of FIG. 4 illustrating the release of a pill from a rotary slat.

In the embodiment shown in FIGS. 2 and 3, the rotary slats 50 can include a plurality of air passages 56 in fluid communication with a corresponding one of the pill receptacles 18. Similarly, as best seen in FIGS. 4 and 5, the wheel-like spacer 50 includes an air passage 55 which communicates with the rotary slat air passage 56 when the receptacle is in the release position 25. The apparatus 10 includes a pressurized air supply which is directed through the stationary spacer passage 55 and the aligned rotary slat passage 56 when the receptacle 18 is at the release position 25. The receptacle 18 includes a channel 56*a* which is formed in the receptacle 18 intermediate the air passage 56 such that pressurized air forces or assists in the ejection of the pill 11 from the receptacle 18 at the predetermined release point 25.

The air supply can be introduced or plumbed into the air passages 55, 56 in many different ways. For example, a central air supply can be positioned at one end of the support shaft 60 and a main air supply channel can be formed therein. Each or selected ones of the stationary slats 50 can then include channels connecting the main air passage in the shaft 60 to the ejection air passage 55.

In any event, in operation, the rotary slat 15 advances to the release position 25, and the receptacle air passage 56 aligns with the stationary spacer air passage 55. A "puff" of pressurized air is injected into the pill receptacle 18 assisting in the release of the pill 11 from the receptacle. Further and advantageously, this burst of air can clean the rotary slat 15 and remove particulate matter such as pill dust from the receptacle 18.

FIGS. 1 and 3 illustrate further preferred features of the apparatus. For example, a brush bar 22, which rotates against the direction of rotation of the rotary slats 15, assists in seating the captured pill 11 in the receptacle 18 and also diverts additional pills away from the delivery path (see also FIG. 6). A cover 80 is positioned adjacent the brush bar 22 to assist in maintaining the pill 11 in place during travel to the filling station. Preferably, the cover 80 is sized and configured to yield a one pill clearance relative to the top surface of the rotary slat 15. The cover 80 can also facilitate cleanliness by preventing environmental debris from entering the delivery path or contacting the captured pill 11. Preferably, the cover 80 is a flexible thin material such as a Teflon® blanket. The reservoir 12 employs a conventional vibrator to assist in the insertion of the pills 11 into the rotary slats 15.

The apparatus also includes a conveyor system 30 to automatically move the containers 35 to and away from the filling stations 33 at the proper time intervals. In one embodiment, as shown in FIG. 1, the conveyor system 30 employs a screw auger 31 which advances the containers 35 to the corresponding filling stations 33. However, as would be appreciated by those of skill in the art, many alternative conveyor systems (such as a belt (see FIG. 8), a flat linked chain, or even a vibratory floating feed system) can also be employed with the apparatus of the present invention. In operation, as schematically illustrated in FIG. 3, the conveyor system 30 is controlled by the central controller 45.

In this way, in the normal course of filling, containers 35 are advanced to the respective filling stations and stopped. At the end of the filling operation, the controller 45 will direct the filled containers out of the filling stations and direct unfilled containers thereto. However, if any one container is determined to be underfilled (as will be discussed further below) the controller 45 will not advance the containers (or at least that container) and direct the individual rotary slat at the underfilled station to rotate forward, thereby advancing an increased number of released pills to fill the underfilled container 35. The controller 45 then will release the container(s) and cause the conveyor system 30 to advance the container(s) out of the filling station(s).

Preferably, once properly positioned at the filling stations 33, the rotary slats 15 are all rotated at the same time and speed to begin the filling operation and slowed at the same time to a slower fill rate at a count close to the desired full count. Because the rotary slats 15 are all rotated concurrently the slats should fill the containers 35 at substantially the same rate, increasing throughput for the filling operation.

As shown in FIG. 4, the positive count packaging apparatus 10 includes a counting device 65 associated with each filling station 33. Preferably, the device 65 is sized and configured to extend between the rotary slat 15 and the opening in the container. Further preferably, the device 65 will be positioned substantially adjacent the opening in a chute 66 above the container 35 so that any pill which travels through the device will enter the container without falling outside the delivery path. It will be appreciated that the chute 66 is not always necessary and may be omitted if the tops of the containers 35 are sufficiently close to the rotary slats 15.

The counting devices 65 can all be mounted together with the chutes 60 to correspond with the spacing of the rotary slats 15 on a stationary support member 67 which extends across the width of the rotary slats 15. As with the drive device support member 41, the counting device support member 67 can be easily changed out and substituted by a different support member having counting devices and chutes mounted thereon when it is desired to package differently shaped pills or for any other reason to use different slats. For example, to provide more rapid filling of individual containers 35, an elongated chute can be positioned for feeding pills 11 from multiple rotary slats 15 into a single container. The individual drive devices for those slats can be mechanically or electrically linked together or the slats can be mechanically fastened together and driven by a single drive device. Further, an additional fully independent rotary slat can feed into the same chute to slowly complete the desired count after the majority of the count has been filled by the linked slats.

Figure 8:
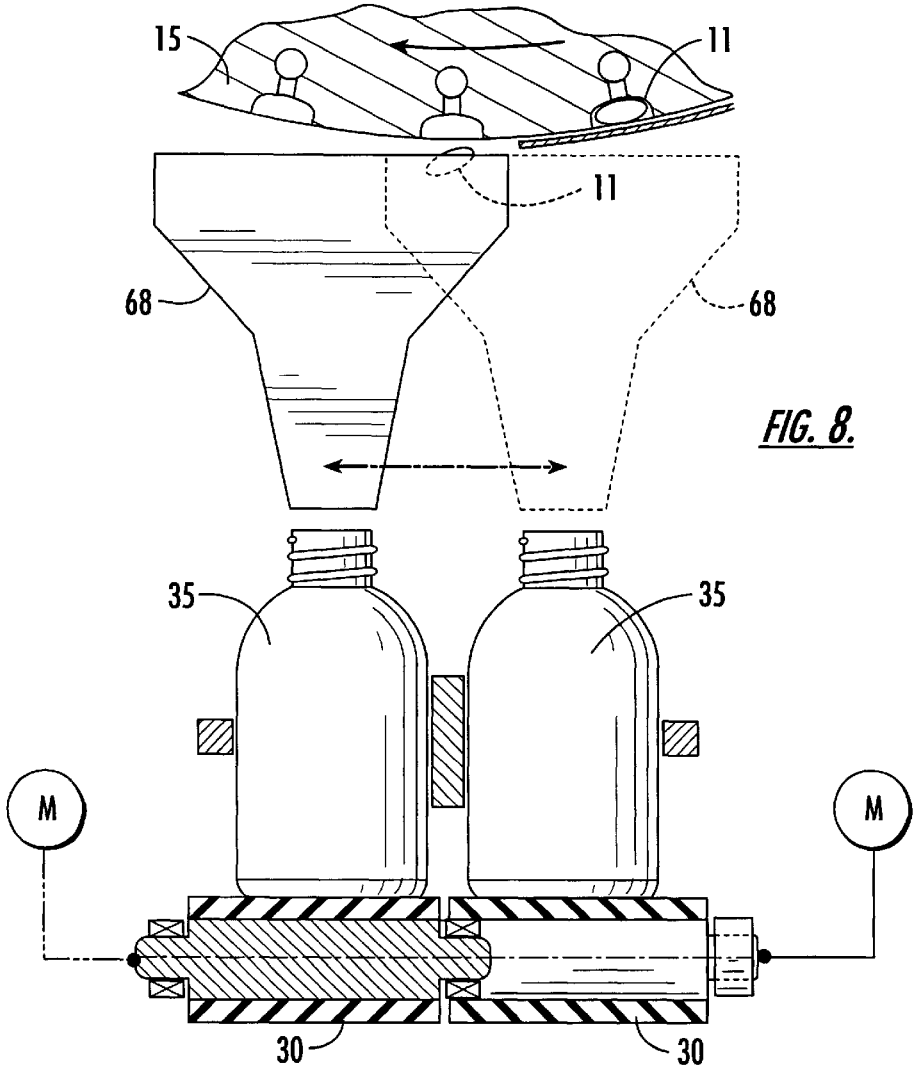
FIG. 8 is an end view of the conveyor illustrating a movable pill chute according to one embodiment of the invention.

A movable chute 68 is illustrated in FIG. 8 for shuttling between two rows of containers 35 on separate belt conveyors 30. The movable chute 68 has a width such that pills 11 will always be collected by the chute, regardless of its position. However, by moving the chute 68 back and forth as illustrated, the apparatus can first fill one container 35 and then immediately begin to fill a neighboring container. Thus, the rotary slats 15 can rotate continuously without any "downtime" while waiting for a single conveyor to advance the row of containers. A counting device 65, although not illustrated in FIG. 8, is positioned to count every pill 11 which is dropped. The counting device 65 could, for example, be positioned at the exit of the chute 68, or even within the chute.

A preferred counting device 65 is illustrated in FIG. 5 and includes an infrared light source 70 and a light receiver 71 positioned substantially opposite the light source 70 across the central passage of the device. The light source 70 generates a substantially planar light beam 72 which is detected by the opposing light receiver 71. When the light beam 72 is interrupted by a falling pill 11, the light receiver 71 transmits a signal which increases the count in the controller 45. The number of interruptions corresponds to the number of pills 11 which have been introduced into the container 35. Thus, generally described, a pill 11 is released (a process which may be assisted by a puff of air) from the receptacle 18 into the device 65. The pill 11 falls through the central passage of the device 65 interrupting the light beam 72 extending thereacross causing the counter to increase each time the beam is interrupted.

The device 65 can also include an audible or visible alarm 62 at each filling station 33, such as an LED (light emitting diode) which is activated upon determination of a problem such as an incorrect count in the respective container 35. Alternatively, a central alarm can be provided by the controller 45. The operator can manually rectify the problem such as by adding or removing pills to provide an accurate count.

Preferably, however, the controller 45 will automatically correct for underfill situations by rotating the rotary slat 15 a predetermined angle and advancing more pills into the container 35. Additionally, and advantageously, the controller 45 can accumulate information about each filling station 33 and indicate that maintenance needs to be performed for respective filling stations, such as when count problems exist more than a statistically valid number of times within a predetermined period. This can facilitate efficient operation of the apparatus. For example, an underfill or slow fill situation may indicate improper alignment of the counting device at the filling station, a malfunctioning drive motor, plugged receptacles, and the like. The controller 45 can also compare the counts in the containers 35 as amongst filling stations 33 to determine any irregularities therebetween.

Although only one light source/receiver pair has been described above, a plurality of same can be employed to generate a series of beams at different positions across the delivery path for system redundancy and to determine and statistically compare the average time of beam interruption. The elapsed time between beam interruptions can be used to determine if an odd shaped, shattered or otherwise undersized pill is being delivered to the container. Similarly, it would be appreciated by one of ordinary skill in the art that various other counting devices could be used including laser sensors and mechanical trip switches.

In operation, as illustrated by FIGS. 1 and 3, pills 11 are fed into a reservoir 12. Containers 35 are advanced along a travel path defined by the conveyor system 30 and stopped at respective filling stations 33. The rotary slats 15 are rotated at the same time and speed into an opening 13 in the reservoir 12 (such as at a lower portion of the reservoir) to capture a pill in each of the receptacles 18 of each of the slats 15 at position 20. The rotary slat 15 continues forward in a clockwise direction to define an arcuate travel path for the pill. The rotary slat 15 is then engaged by the brush bar 22 rotating in a counter clockwise direction at the top of the arc. The brush bar 22 is sized and configured to contact the exposed outer surface of the rotary slat 15 to ensure that the pills 11 are properly seated in the respective receptacles 18 and to divert any excess pills therefrom.

As the rotary slat 15 proceeds forward, the pill 11 remains captured in the receptacle 18 and the exposed edge is covered by the cover 80 which extends until the release position at the bottom of the arc, position 25. At the release position 25, the pill 11 is released and pulled by gravitational forces through the counting device 65. Optionally, the pill is also forced by a burst of air into the delivery path defined between the rotary slat 15 and the opening of the container 35. As the pill 11 falls through the counting device 65 it interrupts the light beam 72 generated by the light source 70 extending across the passage of the device 65. The interruption is sensed by the receiver 71 and causes a corresponding signal to indicate the current count of pills delivered into the container. The rotation of the rotary slats 15 is substantially constant during the above described sequence.

After a predetermined positive count of pills has advanced into the container 35, the controller 45 optionally slows the speed of the rotary slats 15 to help prevent overfilling of the containers. Typically, each container will be filled with the same count at the same time. The rotary slats 15 are then halted and wait for the next group of containers to advance. However, if a count is determined to be incorrect, as stated above, an alert will occur and the controller will individually advance any rotary slat to automatically correct for any underfilled container. Once all containers are correctly filled, or corrective measures taken, the filled containers are advanced out of the filling stations and unfilled containers are advanced therein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An automated packaging apparatus for depositing a predetermined number of pills into a series of containers, comprising:

a reservoir configured to hold a plurality of pills and defining at least one opening adjacent a lower portion thereof;

a plurality of rotary slats each having a peripheral edge portion rotatable into the opening in said reservoir, said peripheral edge portions of said rotary slats each defining a plurality of pill receptacles configured to capture a individual pill at a first position in said reservoir and release the pill at a second position outside of said reservoir;

a conveyor configured to move a plurality of open containers along a predetermined path of travel and position each container adjacent a respective rotary slat to define a delivery path extending between the second position of said rotary slat and the container such that the pills are released from the slat and fall along said delivery path into the corresponding container; and a counting device disposed along each of said delivery paths for continuously counting pills delivered along the path such that the number of pills passing into each container can be positively determined, said counting device being positioned between the second position of the respective rotary slat and the respective container and constantly sensing for pills falling past the counting device so as to positively count all pills that fall along the delivery path and into the container regardless of the duration between each successive pill.

2. A packaging apparatus according to claim 1 wherein each of said counting devices is disposed adjacent to the respective open container and includes a light source which generates a continuous beam of light across the delivery path and an opposing light receiver which senses when the light is interrupted by each pill passing into the container.

3. A packaging apparatus according to claim 2 wherein said light source generates a planar beam which extends across the delivery path and is substantially parallel to an adjacent opening of each container.

4. A packaging apparatus according to claim 1 further comprising an alarm in association with said counting devices which generates an alert when any one of the containers does not contain a predetermined number of pills after a predetermined amount of time.

5. A packaging apparatus according to claim 1 further comprising a second counting device disposed along each of said delivery paths for counting pills delivered along the path.

* * * * *